US006358085B1

(12) United States Patent
Wislinski et al.

(10) Patent No.: US 6,358,085 B1
(45) Date of Patent: Mar. 19, 2002

(54) CONNECTOR ASSEMBLY

(75) Inventors: Martin T. Wislinski, Edison; Wali Shah, Newark; John Rako, Annandale, all of NJ (US)

(73) Assignee: TyCom (US) Inc., Morristown, NJ (US)

( * ) Notice: Subject to any disclaimer, the term of this patent is extended or adjusted under 35 U.S.C. 154(b) by 0 days.

(21) Appl. No.: 09/459,907

(22) Filed: Dec. 14, 1999

(51) Int. Cl.[7] ..... H01R 31/08
(52) U.S. Cl. ..... 439/509; 439/574
(58) Field of Search ..... 439/574–5, 92, 439/108, 507, 509, 939, 912, 60, 924.1, 367, 521; 361/212, 220; 333/22 R; 174/59, 60; 248/500, 506, 680, 681; 403/164, 165, 321

(56) References Cited

U.S. PATENT DOCUMENTS 2,431,999 A * 12/1947 Engelhardt ..... 173/328
5,777,484 A * 7/1998 Woith et al. ..... 324/754

* cited by examiner

*Primary Examiner*—Gary Paumen
*Assistant Examiner*—Ann McCamey

(57) ABSTRACT

A connector assembly is disclosed. In an embodiment for the connector assembly, the assembly includes a shorting plate, a shorting connector, and a connector holder. The connector holder includes a clamp arm and a base. The base is attached to the shorting plate and the shorting connector is disposed between the base and the clamp arm. In an embodiment for the connector, the connector includes a cap block and a socket support dispose on a first side of the cap block. First and second sockets, having a first end and a second end, are disposed on the socket support. The first end of the first socket extends beyond the first end of the second socket. A support block is connected to the cap block wherein the first and second sockets and the socket support are disposed between the support block and the cap block.

8 Claims, 5 Drawing Sheets

CONNECTOR ASSEMBLY

BACKGROUND OF THE INVENTION

The present invention relates to a connector assembly. More specifically, the invention provides a connector that may be utilized to both physically protect the leads associated with an opto-electronic component, such as a laser pump module, and to electrically protect the opto-electronic component by commonly grounding the leads of the component. Additionally, the connector may be utilized as an electrical connector to, for example, electrically connect the component to a test set. The connector assembly utilizes the connector to ground a plurality of components to a common grounding surface.

As can be seen in FIG. 1, a ribbon cable 20 extends from a laser pump module 10. A first end 22 of ribbon cable 20 connects to laser pump module 10 and a second end 24 of ribbon cable 20 includes exposed leads 24A–E. As can be seen, the exposed leads have varying lengths and a lead with a shorter length is positioned next to a lead with a longer length, i.e., the leads are staggered so that adjacent leads have different lengths. The leads are staggered in this manner because of the relationship between the spacing between the leads in the standardized ribbon cable and the size of each receptacle into which each lead is inserted when the laser pump module is integrated into an optical circuit, such as in a fiber optic repeater. The receptacles are those that are approved for use with undersea fiber optic cable systems. Because the size of each receptacle is such that if each of the five required receptacles are positioned adjacent to each other, each female portion of each receptacle would not align with its respective ribbon cable lead. Thus, the distance between adjacent female portions of adjacent receptacles is greater than the distance between adjacent ribbon cable leads. For example, the standard ribbon cable as used in submarine fiber optic cable systems has leads that are positioned approximately 0.100 inches apart. If the receptacles were positioned adjacent to each other, their female portions would be positioned farther apart than this distance between the adjacent leads in the ribbon cable.

Therefore, in order to position the receptacles such that each of the receptacles can align with their respective ribbon cable lead, their positioning is staggered with respect to each other. Adjacent receptacles are positioned one behind the other such that their female portions can align with their respective ribbon cable leads. However, since adjacent receptacles are positioned one behind the other, the lengths of adjacent leads must vary such that each lead is long enough to be able to be received within its respective receptacle. Thus, the second end 24 of ribbon cable 20 is configured as illustrated in FIG. 1.

Because of the relationship described above between the leads of the laser pump module and the equipment receptacles into which they are received, the lengths of the leads are as described above. However, when the laser pump module is not inserted into the equipment and when it is desired to physically protect the leads and/or electrically protect the pump module by commonly grounding the leads and/or electrically connect the laser pump module to a test set, a standard type of connector cannot be utilized. A standard connector is not to adequately accommodate the varying lead lengths of the ribbon cable and is not able to perform all functions required. For example, a known connector has deficiencies. The connector is merely a sheet metal clip. The clip has fingers on it where each finger is supposed to engage a lead. However, the fingers may be easily disengaged from the leads. Additionally, the clip is not able to physically protect the leads since the merely clips onto the leads. The leads are not received within the connector and thus are not adequately protected. Also, whereas it may be attempted to utilize the clip for commonly grounding the leads, the clip does not include structure which allows it to be mounted on a fixture. Therefore, if it is desired to ground a plurality of laser pump modules to a common grounding surface, the known clip is inadequate because it cannot be mounted to the common grounding surface. An additional problem is that the clip cannot be utilized to connect the leads to a test set.

Therefore, it would be desirable to provide a connector assembly. The connector assembly could include an improved connector that could be utilized to both physically protect the leads of an opto-electronic component and to electrically protect the component by commonly grounding the leads of the component. The connector could also be utilized to electrically connect the component to a test set. The connector assembly could provide for physically supporting and electrically grounding a plurality of components.

SUMMARY OF THE INVENTION

In accordance with the present invention, a connector assembly is provided. In an embodiment for the connector assembly, the assembly includes a shorting plate, a shorting connector, and a connector holder. The connector holder includes a clamp arm and a base. The base is attached to the shorting plate and the shorting connector is disposed between the base and the clamp arm.

In an embodiment for the connector, the connector includes a cap block and a socket support disposed on a first side of the cap block. First and second sockets, having a first end and a second end, are disposed on the socket support. The first end of the first socket extends beyond first end of the second socket. A support block is connected to the cap block wherein the first and second sockets and the socket support are disposed between the support block and the cap block.

BRIEF DESCRIPTION OF THE DRAWINGS

The various features of the invention will best be appreciated by simultaneous reference to the description which follows and the accompanying drawings, in which.

DETAILED DESCRIPTION

Figure 1:
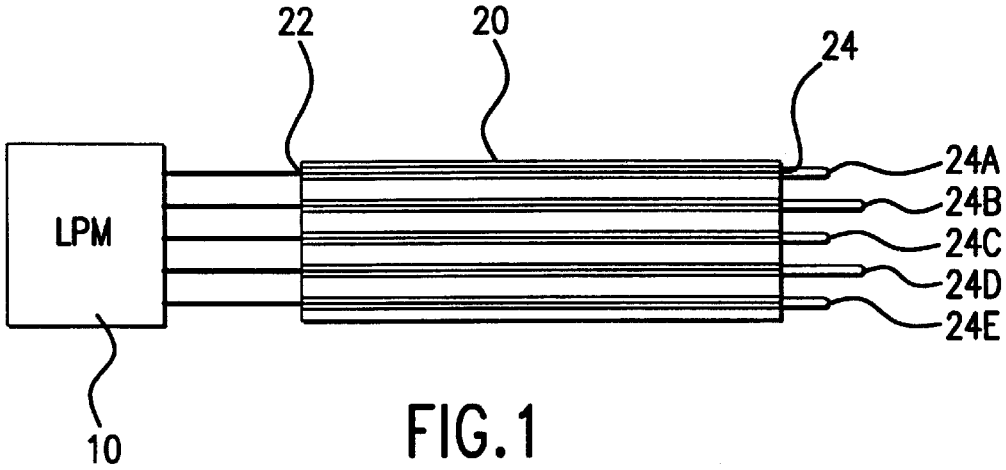
FIG. 1 illustrates a laser pump module and its associated ribbon cable.
Figure 2:
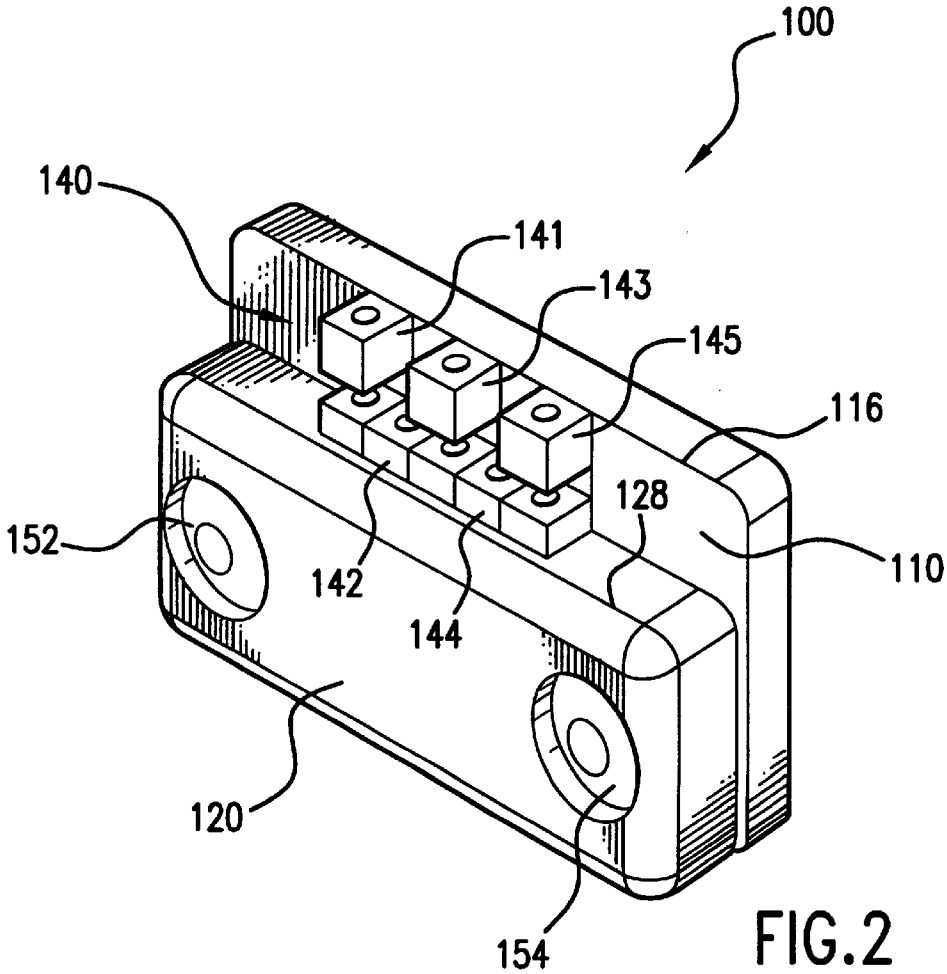
FIG. 2 is a perspective view of a connector in accordance with the principles of the present invention.

FIG. 2 illustrates an embodiment for a connector 100 in accordance with the principles of the present invention. As will be further explained later in this specification, connector 100 can be utilized for any of a variety of purposes, including physically protecting the leads associated with a component, e.g., an opto-electronic component such as a laser pump module, and electrically protecting the component by commonly grounding the leads of the component. Additionally, the connector may be utilized as an electrical connector to, for example, electrically connect the component to a test set. Thus, connector 100 is not limited to any particular use and has utility for any of a variety of different applications.

As can be seen in FIG. 2, connector 100 includes a cap block 110, a support block 120, and a socket assembly 140 which includes a plurality of sockets which receive within them electrical leads from a ribbon cable. Support block 120 is connected to cap block 110 by connecting hardware, such as screws 152 and 154 which extend through support block 120 and into cap block 110 in order to secure support block 120 to cap block 110. As will be further described later in this specification, support block 120 is hollow within at least a portion of it. Socket assembly 140 is disposed within the hollow portion of support block 120 and between support block 120 and cap block 110.

As can be further seen in FIG. 2, socket assembly 140 includes individual sockets 141, 142, 143, 144, and 145. The present invention is not limited to any particular number of sockets in socket assembly 140. As can be seen, adjacent sockets are staggered with respect to their positioning relative to support block 120 and cap block 110. Thus, sockets 141, 143, and 145 extend greater distance from edge surface 128 of support block 120 than do sockets 142 and 144. As can be seen, sockets 141, 143, and 145 extend from support block 120 such that they are substantially aligned with edge surface 116 of cap block 110. Sockets 142 and 144 extend from support block 120 such that they are substantially aligned with edge surface 128 of support block 120. Therefore, sockets 141, 143, and 145 extend a greater distance from edge surface 128 of support block 120 than do sockets 142 and 144. As such, sockets 141, 143, and 145 are substantially aligned with edge surface 116 of cap block 110 and sockets 142 and 144 are substantially aligned with edge surface 128 of support block 120.

The sockets are aligned as described above so that they are able to receive within them a respective lead or cable 20. As can be understood, the sockets which extend further from edge surface 128 of support block 120 receive the shorter of the leads of the ribbon cable within them and the sockets which are aligned closer to edge surface 128 receive within them the longer leads. Thus, the sockets are positioned such that they receive within them a respective one of the leads of the ribbon cable. Thus, socket 141 would receive within it lead 24A, socket 142 would receive within it lead 24B, socket 143 would receive within it lead 24C, socket 144 would receive within it lead 24D, and socket 145 would receive within it lead 24E. As explained earlier, the staggered positioning of the sockets is such that the sockets are appropriately positioned to receive within them a particularly-sized lead.

Because the sockets are staggered in their positioning, it can be understood that if sockets 142 and 144 were not externally aligned with respect to edge surface 128 of support block 120, i.e., if they were disposed within support block 120, it could be difficult to position the respective leads within those particular sockets. Even if sockets 141, 143, and 145 extended outside of support block 120, if sockets 142 and 144 were disposed within support block 120, it would be difficult to align lead 24B with socket 142 and lead 24D with socket 144 since these sockets would not be visible. Therefore, the present invention allows for visibility of all of the sockets of the connector. As such, a technician is more easily able to align each of the leads with a respective receptacle that is to receive the lead. The visibility of all of the sockets of the connector is particularly important when the connector is utilized with an optical component, and associated ribbon cable, that is a high reliability component, such as one used in a fiber optic repeater. If the sockets were not visible, the leads could be damaged when an attempt is made to blindly insert the leads into the receptacles. any damage to the leads could result in a loss of reliability for both the component and the system into which the component is integrated.

FIGS. 3–6 further illustrates connector 100 of the present invention. As can be seen, cap block 110 is a generally rectangular structure that includes two apertures, of which only aperture 112 is visible in FIG. 3. Cap block 110 may be manufactured from any of a variety of electrically conductive materials, however, it is desired that cap block 110 be manufactured from aluminum. It is desired that black 110 be manufactured from aluminum, not only because aluminum is an electrically conductive material, but that is is also a relatively light weight material. This is desirable because, if cap block 110 was comprised of a heavier material, such as copper, cap block 110 may apply too much bending pressure on the leads. This could be possible in a configuration where the leads are positioned within the sockets and the connector 100 is not adequately supported. The heavier weight of cap block 110 could serve to bend, and thus damage, both the leads that are inserted into the connector and the leads that are at the opposed end of the ribbon cable and that are connector to the optical component, e.g., the laser pump module. Excessive force on the leads could, for example, break the solder joint that connects the leads to the pump module. The aperture in cap block 110 receive within them screws 152 and 154 which, as described previously, secure support block 120 to cap block 110.

Also included in connector 100 is socket support 130. Socket support 130 is a flat rectangular plate onto which the sockets of socket assembly 140 are positioned. Similar to cap block 110, socket support 130 should be comprised of an electrically conductive material. It is desirable to comprise socket support 130 from copper because, as will be explained further later in this specification, if connector 100 is to be utilized as a shorting connector, it is possible to solder a shorting wire, which would extend across the male portions of the sockets, to socket support 130.

Thus, the materials that are utilized for comprising both cap block 110 and socket support 130 should be electrically conductive. Additionally, the materials should be light enough so that the ribbon cable leads are not damaged but yet be rigid enough so as to resist damage.

Figure 3:
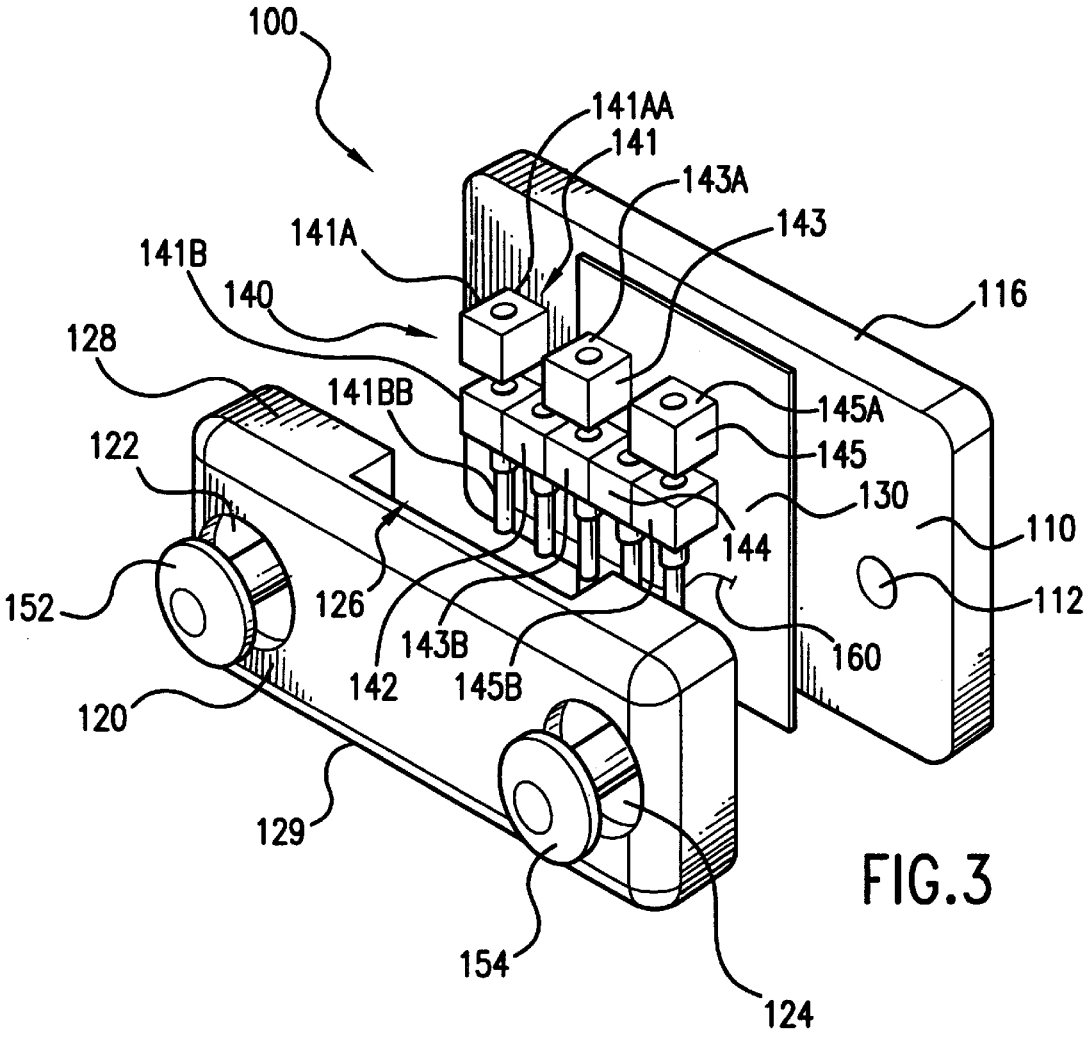
FIG. 3 is an exploded perspective view of the connector of FIG. 2.
Figure 4:
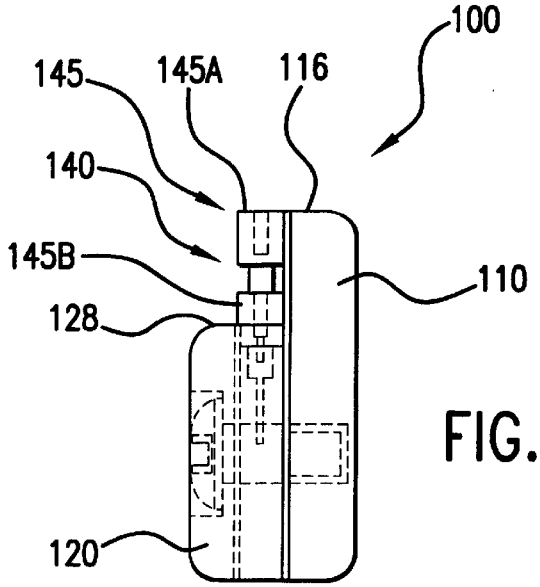
FIG. 4 is a side view of the connector of FIG. 2.
Figure 5:
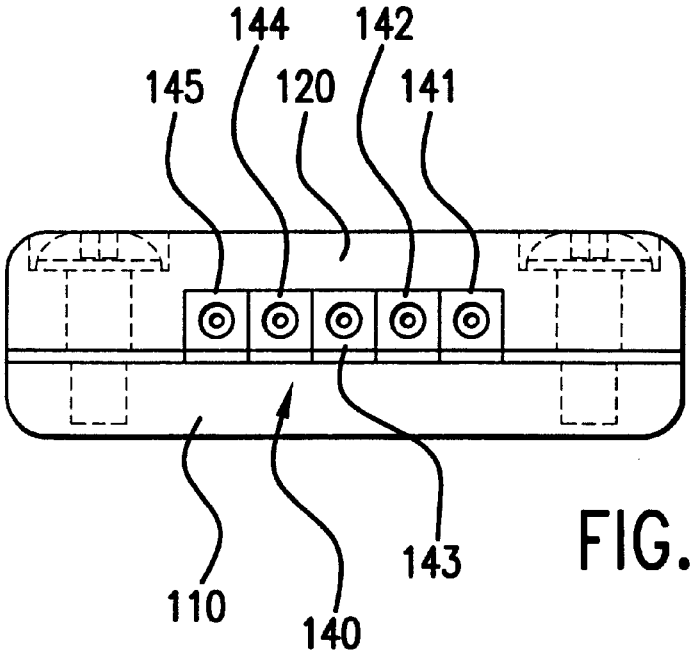
FIG. 5 is a front view of the connector of FIG. 2.
Figure 6:
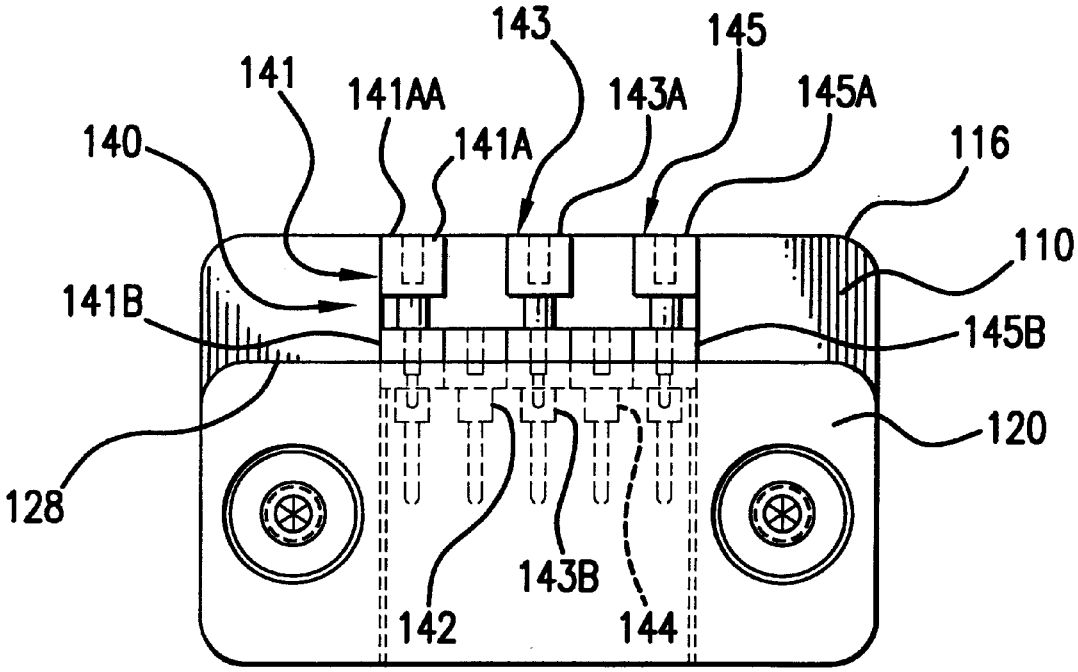
FIG. 6 is a top view of the connector of FIG. 2.

As was described earlier in this specification, connector 100 includes socket assembly 140. As can be seen in FIG. 3, socket 141, which extends a greater distance from edge surface 128 of support block 120 then does its adjacent socket 142, is comprised of a first socket member 141A and a second socket member 141B. Both socket members are comprised of the same structure, however, in order to achieve the greater extension of socket 141 from support block 120, the male portion of first socket member 141A is inserted within the female portion of second socket member 141B. Thus, first socket 141 is essentially a piggy-back structure that is comprised of two sockets disposed one within the other. As such, as described previously, first socket 141 has a first end 141AA that is positioned generally adjacent with edge surface 116 of cap block 110 and includes a second male end 141BB that is disposed within support block 120. Socket 142, as discussed previously, is positioned adjacent to socket 141 and includes a first end that is aligned substantially with edge surface 128 of support block 120 and a male portion which is disposed within support block 120. The male portion of socket 142 is aligned adjacent to the male portion of first socket 141. Sockets 143 and 145 are formed and positioned similarly to first socket 141. As such, socket 143 includes a first socket member 143A that has a first end that is aligned substantially with edge surface 116 of cap block 110. Socket 143 includes a second socket member 143B which is disposed at least partially within support block 120. Similarly, socket 145 includes a first socket member 145A and a second socket member 145B. Socket 145 is aligned similar to sockets 141 and 143.

Socket 144 is formed and positioned similar to socket 142. As such, socket 144 includes a first end that is substantially aligned with edge surface 128 of support block 120 and a male portion which is disposed within support block 120. Socket assembly 140 may secured to, attached to, attached to, or positioned on socket support 130 by any of a variety of means, including soldering of the sockets to the socket support 130. Alternatively, the sockets may be secured to socket support 130 by utilizing an adhesive. However, it is not even required that the sockets be secured to socket support 130. Rather, the sockets may be retained in their relative position with respect to connector 100 by their positioning between support block 120 and cap block 110.

The sockets may be comprised of those that are commercially available. For exampler, MILL-MAX® sockets, stock number 66F9246, as available from Newark Electronics® may be utilized. Alternatively, sockets with a part number of H3194-XX (T6 or 05) may be utilized which are available from Harwin Inc., P.O. Box 319, New Albany, Ind. 47151. The present invention is not limited to any particular type of socket and any of a variety of different sockets may be utilized in practicing the present invention.

As described previously, connector 100 also includes support block 120. As can be seen in FIG. 3, support block 120 defines a rectangular groove 126 within it. The sockets are positioned within rectangular groove 126 and thus are maintained in their relative position with respect to cap block 110 and support block 120. Support block 120 may be comprised of any of a variety of materials, however, a particular desired material is TYWAR 1000, which as an electro-static discharge safe (ESD) semi-conductive material. A support block that is available from Commercial Plastics, Newark, N.J. may be utilized in the present invention.

Support block 120 includes screw apertures 122 and 124 which receive through them screws 152 and 154, respectively, which secure support block 120 to cap block 110. Whereas it is not visible in FIG. 3, back edge 129 of support block 120 may include an aperture within it such that electrical leads may be brought through support block 120 to mate with the male portions of sockets 140. Thus, if connector 100 was to be utilized as an electrical connector, such as for example for connecting a component to a test set, the electrical leads could extend through connector 100 to connect with the sockets.

Thus, as described above, a connector is provided that can be utilized for any of a variety of purpose, including as a shorting connector or a test set connector. If the connector is to be utilized as a shorting connector, as can be seen FIG. 3, a shorting wire 160 would be connected to each of the male portions of the sockets. Thus, the shorting wire would connect to an electrically conductive portion of each socket and would also connect to socket support 130. As discussed earlier, socket support 130 is in connection with electrically conductive cap block 110. Thus, through the interconnection of each socket by shorting wire 160 and the shorting wire's connection to socket support 130, all of the sockets may be taken to a common ground. If connector 100 is not utilized as a shorting connector, but rather is utilized as an electrical connector, e.g., a test set connector, shorting wire 160 would not be utilized. Instead, electrical leads would be mated with the sockets.

Figure 8:
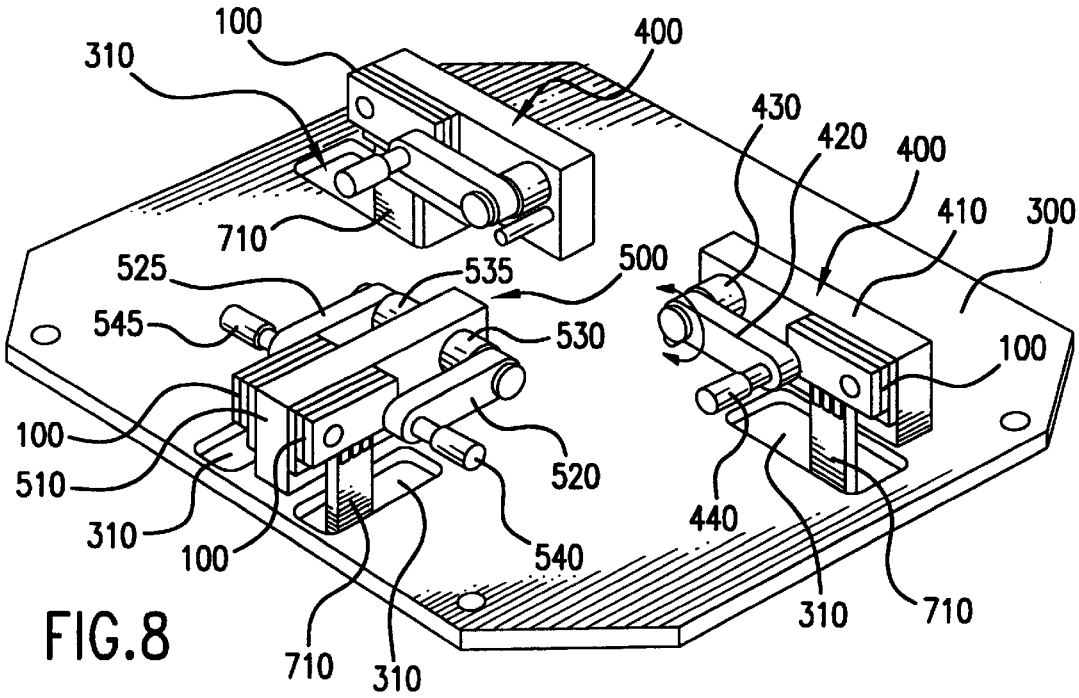
FIG. 8 is a perspective view of the connector assembly of FIG. 7.
Figure 9:
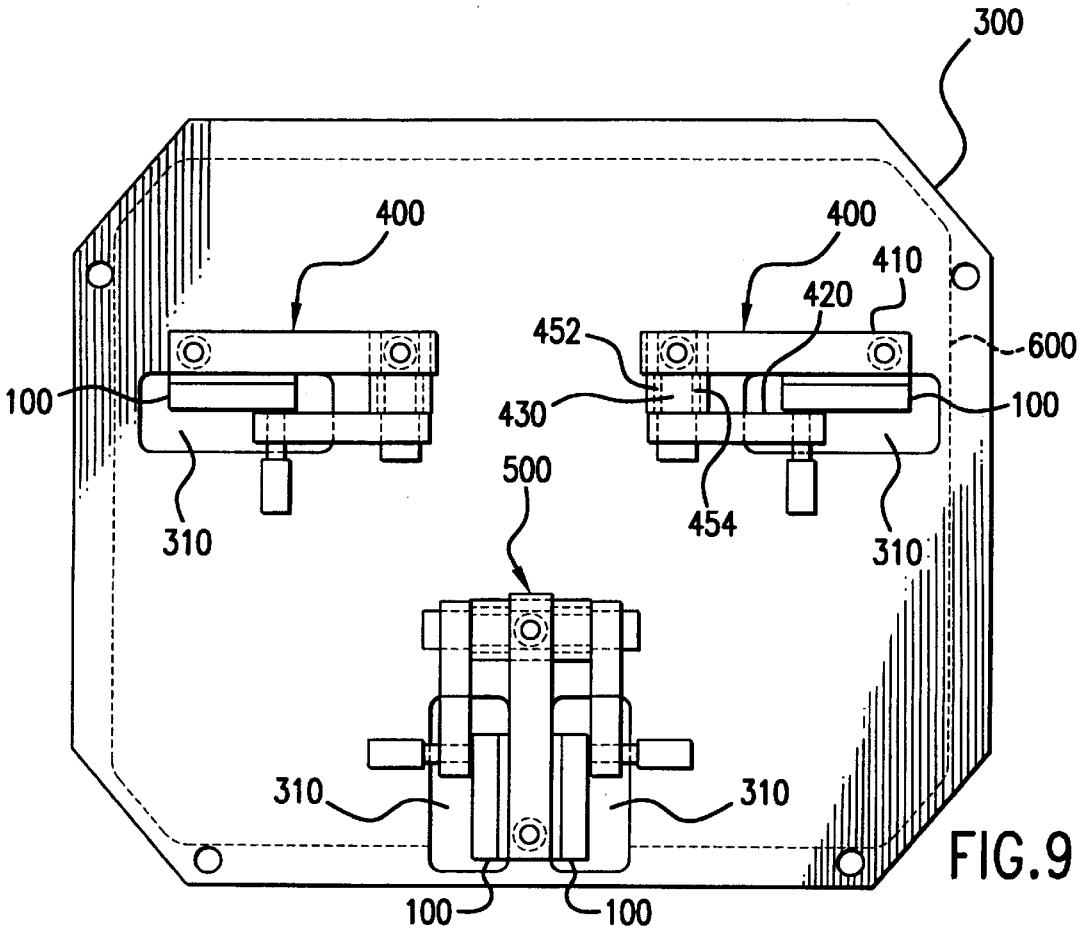
FIG. 9 is a top view of the connector assembly of FIG. 7.

If connector 100 is to be utilized as shorting connector, the present invention provides a connector assembly 200 that may be utilized to ground a plurality of connectors 100 to a common ground. Connector assembly 200 is illustrated in FIG. 7–9.

Figure 7:
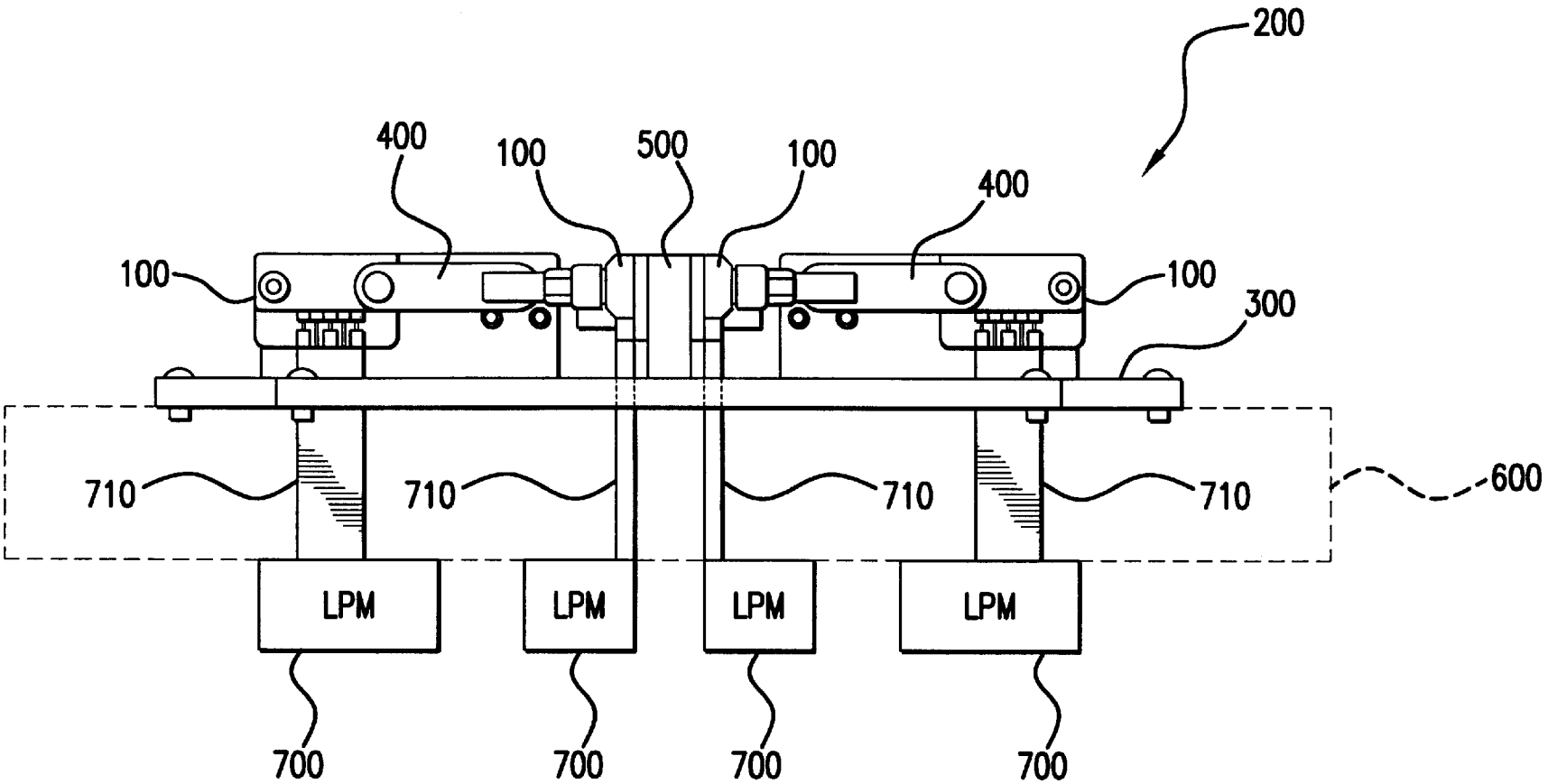
FIG. 7 is a side view of a connector assembly in accordance with the principles of the present invention mounted on the underside of a laser pump module tray.

As can be seen in FIG. 7, connector assembly 200 is disposed on an underside of, for example, a pump tray 600. Pump tray 600 may be comprised of any of a variety of structures and may include on it any of a variety of opto-electronic components. In one embodiment, try 600 includes as laser pump module assembly which includes a plurality of laser pump modules 700. As can be seen, extending from each laser pump module 700 is a ribbon cable 710. Ribbon cable 710 extends through pump tray 600 and into connector assembly 200. As will be further described later in this specification, connector assembly 200 is comprised of a shorting plate 300 upon which are mounted a plurality of connector holders. Each connector holder is adapted to secure within it a connector 100, to which is attached a ribbon cable 710. Thus, through connector assembly 200, as will be further explained, a plurality of laser pump modules may be grounded to a common grounding surface, ie., shorting plate 300. Each laser pump module 700 is grounded to shorting plate 300 through interconnection of its respective ribbon cable 710 with a connector 100 and the respective connector holder which holds connector 100 within it. FIGS. 8 and 9 further illustrate connector assembly 200.

As can be seen, connector 100 is securely positioned and held within a connector holder. As will be discussed below, FIGS. 7–9 illustrate two embodiments for a connector holder in accordance with the principles of the present invention, namely those designated as connector holders 400 and 500. Connectors 100 which are illustrated in FIGS. 7–9 are as described previously in this specification.

The embodiment of connector holder 400 will now be further described with reference to FIG. 8. Connector holder 400 includes a base 410, a clamp arm 420, a spacer 430, and an engagement member 440. Base 410 is a rectangular structure and is comprised of an electrically conductive material, preferably aluminum. Thus, base 410, which mates with cap block 110 of connector 100, which is also comprised of aluminum, provides an electrically conductive path from connector 100 to shorting plate 300. Base 410 of connector holder 400 is in contact with shorting plate 300 and can be attached to shorting plate 300 by any of a variety of means with the only requirement being that an electrically conductive path exist between base 410 and shorting plate 300. For example, base 410 can be attached to shorting plate 300 by utilizing an electrically conductive adhesive. Alternatively, base 410 can be welded to shorting plate 300. As mentioned previously, any of a variety of attachment mechanisms and methods can be utilized to securely attach base 410 to shorting plate 300.

As described previously, connector holder 400 also includes clamp arm 420. Clamp arm 420 is rotatably attached to base 410 such that clamp arm 420 may be rotated away from connector 100 and may be rotated towards connector 100 such that clamp arm 420 is able to engage with connector 100. Included in clamp arm 420 is engagement member 440, which may be a thumb screw. Engagement member 440 extends through clamp arm 420 and is threaded through clamp arm 420. A distal end of engagement member 440 extends through clamp arm 420 and abuttingly engages with connector 100. By threading engagement member 440 through clamp arm 420, the distal end of engagement member 440 engages with connector 100 and frictionally secures connector 100 between clamp arm 420 and base 410. Engagement member 440 maybe threaded into support block 120 of connector 100, however, this is not required in order to secure connector 100 within connector holder 400. All that is required is that sufficient pressure bear on connector 100 by engagement member 440 to ensure that connector 100 is securely positioned between clamp arm 420 and base 410. As stated previously, clamp arm 420 is rotably connected to base 410 and is spaced from base 410 a distance which is substantially equivalent to the width of shorting connector 100. Thus, connector 100 is able to be positioned between clamp arm 420 and base 410 and engaged with engagement member 440. As can be understood, through the structure of connector holder 400, connector 100 can be securely positioned within connector holder 400 and thus electrical contact can be made between connector 100, connector holder 400, and shorting plate 300.

As can be seen in FIG. 9, each connector holder 400 also includes two restrainer pins 452 and 454 which are positioned under clamp arm 420 and on opposing sides of spacer 430. The pins extend perpendicular from the face of base 410 and are utilized to ensure that clamp arm 420 may be maintained in a horizontal position, and thus a parallel position, with respect to shorting plate 300. It can be understood that if the restrainer pins were not utilized, clamp arm 420 would be free to rotate fully such that it would engage with shorting plate 300. Whereas this may not be detrimental when clamp arm 420 is rotated away from connector 100, it would not be desirable when clamp arm 420 is rotated toward connector 100 in order to secure connector 100 between clamp arm 420 and base 410. Thus, by restraining the movement of clamp arm 420 with the pins, clamp arm 420 is accurately positioned with respect to connector 100 and base 410 to secure connector 100 between clamp arm 420 and base 410.

As can be seen in FIGS. 7–9, a plurality of connector holders may be secured to connector plate 300 such that a plurality of connectors 100 may be shorted to shorting plate 300. An alternative embodiment for a connector holder 500 is best seen in FIGS. 8 and 9. As can be seen, this second embodiment for a connector holder includes a base member 510 which has clamp arms attached on opposing sides of base 510. Thus, clamp arm 525 is disposed on a first side of base 510 and clamp arm 520 is disposed on a second side of base 510. Clamp arm 525 is spaced from base 510 by spacer 535 and engagement member 545 is utilized to secure a connector 100 between clamp arm 525 and base 510. Clamp arm 520 is spaced from base member 510 by spacer 530 and engagement member 540 is utilized to position a second connector 100 between base 510 and clamp arm 520. Thus, in this alternative embodiment for connector holder 500, connectors 100 may be positioned on both sides of base 510 of connector holder 500.

In further describing shorting plate 300, shorting plate 300 may be comprised of any of a variety of electrically conducting materials. A desired material would be aluminum since this is the same material that both the base of the connector holder and the cap block 110 of connector 100 is comprised of. Shorting plate 300 can be configured in any of a variety of configurations or sizes, with the only consideration being that it should extend over those areas of a tray on which opto-electronic components may be mounted. Shorting plate 300 may be attached to the tray by any of a variety of means, including attachment by utilizing screws.

As can be further seen in FIGS. 8 and 9, shorting plate 300 includes a plurality of apertures 310 within it. An aperture is included below each connector holder that is installed on shorting plate 300. The aperture can be of any size or shape, however, it should be large enough such that a connector, and its associated ribbon cable, that is to be secured within a particular connector holder can extend up through the aperture from the tray that is disposed under the shorting plate.

Thus, as described above, connector assembly 200 provides an apparatus that is able to commonly ground a plurality of connectors. The connector holder is easy to operate by a technician and does not require any additional connection hardware in order to securely retain a connector within the connector holder. A technician may very easily rotate the clamp arm of the connector holder away from the base in order to position a connector against the base. The technician is then able to easily rotate the clamp arm to a position where the engagement member of the clamp arm may be threaded through the clam arm to engage with the connector in order to secure the connector between the clamp arm and the base of the connector holder. Thus, no additional hardware, other than that integrally included in the connector holder, is required in order to secure a connector within the connector holder.

As can also be seen in FIGS. 8 and 9, the connectors are positioned with respect to shorting plate 300 such that the ribbon cable that extends from the optical tray is not required to be bent in order to secure its connector within a connector holder. That is, the ribbon cable extends in a substantially straight line from the optical pump tray into the connector holder. This provides benefits because in this alignment, the ribbon cable is less likely to be damaged, e.g., bent, or pulled from the connector.

Whereas the disclosed embodiment for the connector assembly includes three connector holders on a shorting plate, the present invention may include any number of connector holders on the shorting plate, depending upon the requirements of the particular system with which the connector assembly is utilized.

The disclosed embodiments are illustrative of the various ways in which the present invention may be practiced. Other embodiments can be implemented by those skilled in the art without departing from the spirit and scope of the present invention.

What is claimed is:

1. A connector assembly for receiving leads from a cable, said assembly comprising:

a cap block having a first surface;

a support block including a hollow portion;

a socket assembly disposed between said surface of said cap block and partially within said hollow portion of said support block;

wherein said sock assembly comprises a plurality of staggered sockets extending along said first surface of said cap block and substantially adjacent each other; and wherein every other of said plurality of sockets includes a first socket member and a second socket member, said first socket member being disposed upon said first surface of said cap block at a location different from the next adjacent said socket.

2. The connector assembly of claim 1 wherein said second socket member is aligned in location with the next adjacent said socket.

3. The connector assembly of claim 1 wherein said socket assembly is comprised of copper.

4. The connector assembly of claim 1 wherein said socket assembly is comprised of aluminum.

5. The connector assembly of claim 1 wherein said socket assembly is comprised of an electro-static discharge material.

6. The connector assembly of claim 1 further comprising a clamp arm rotatably connected to said base.

7. The connector assembly of claim 6 further comprising a restrainer attached to said base.

8. The connector assembly of claim 7 wherein said restrainer includes a first pin and a second pin disposed on opposite sides of a spacer, said spacer being disposed between said clamp arm and said base.

* * * * *